US009812267B2

(12) United States Patent
Hozumi

(10) Patent No.: US 9,812,267 B2
(45) Date of Patent: Nov. 7, 2017

(54) SWITCH

(71) Applicant: OMRON Corporation, Kyoto-shi, Kyoto (JP)

(72) Inventor: Akihiro Hozumi, Okayama (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 15/142,681

(22) Filed: Apr. 29, 2016

(65) Prior Publication Data

US 2016/0351355 A1 Dec. 1, 2016

(30) Foreign Application Priority Data

May 29, 2015 (JP) ..... 2015-110560

(51) Int. Cl.

| | |
|---|---|
| ***H01H 9/06*** | (2006.01) |
| ***B25B 21/00*** | (2006.01) |
| ***H01H 15/00*** | (2006.01) |
| ***H01H 15/22*** | (2006.01) |
| ***H01H 19/58*** | (2006.01) |

(52) U.S. Cl.

CPC ..... *H01H 9/063* (2013.01); *B25B 21/00* (2013.01); *H01H 15/005* (2013.01); *H01H 15/22* (2013.01); *H01H 19/585* (2013.01); *H01H 2009/065* (2013.01); *H01H 2009/066* (2013.01)

(58) Field of Classification Search

CPC ..... H01H 9/063; H01H 15/005; H01H 15/22; H01H 19/585; H01H 2009/065; H01H 2009/066; B25B 21/00

USPC ..... 200/522, 505, 520, 323, 325

See application file for complete search history.

(56) References Cited

U.S. PATENT DOCUMENTS

| | | | | |
|---|---|---|---|---|
| 4,313,041 | A | 1/1982 | Ohashi | |
| 5,570,777 | A | 11/1996 | Skarivoda | |
| 8,193,458 | B2 * | 6/2012 | Hozumi | B25B 21/00 200/1 V |
| 8,653,388 | B2 * | 2/2014 | Nishikimi | H01H 21/08 200/302.3 |
| 9,373,461 | B2 * | 6/2016 | Hozumi | H01H 9/04 |
| 2008/0251269 | A1 | 10/2008 | Hua | |

FOREIGN PATENT DOCUMENTS

| | | |
|---|---|---|
| EP | 2 589 465 A2 | 5/2013 |
| JP | 2011-067910 A | 4/2011 |

OTHER PUBLICATIONS

Extended European Search Report in counterpart European Application No. 16 16 7066.6 dated Feb. 6, 2017 (9 pages).

* cited by examiner

*Primary Examiner* — Edwin A. Leon
(74) *Attorney, Agent, or Firm* — Osha Liang LLP

(57) ABSTRACT

A switch, with enhanced operability and capable of changing control circuits independently by one hand, has a printed circuit board, first and second wiring patterns provided on one surface of the printed circuit board, first and second crank members supported for rotation above the printed circuit board, a first switching slider configured to rotate with the first crank member as the first switching slider slides an the first wiring pattern; and a second switching slider configured to rotate with the first crank member as the second switching slider slides on the second wiring pattern. The first and second crank members are positioned at respective positions where they are driven by one hand of an operator.

5 Claims, 12 Drawing Sheets

SWITCH

CROSS-REFERENCE TO RELATED APPLICATION

This application claims the benefit of Japanese Patent Application No. JP2015-110560, filed May 29, 2015, which is incorporated herein by reference in its entirety.

TECHNICAL FIELD

This invention generally relates to a switch and, for example, a trigger switch, which is incorporated in a power tool and allows an operator of the power tool to individually turn on and off control circuits mounted therein by one hand.

BACKGROUND

Examples of the power tools capable of individually switching a plurality of control circuits include a power driver capable of fastening and loosing wheel nuts for the replacement of vehicle tires. The power driver has a reverse switch 15 which is mounted on a body housing 50, among others, a proximal end of the grip for exchanging rotational directions of the chuck 13. The power driver has a torque switch 59 for increasing and decreasing an output torque, which is mounted on a side portion of the operation panel housing 52 connected at the bottom end of the grip. See FIGS. 1 and 3 of Patent Document 1.

PRIOR ART DOCUMENT(S)

Patent Document 1: JP2011-67910(A)

SUMMARY OF THE INVENTION

The torque switch 59 and the reverse switch 15 of the power driver are spaced away from each other. Then, the operator is unable to operate the reverse switch 15 and the torque switch 59 by one hand, namely, the operator needs to use his or her both hands for the operation of those switches, which may reduce an operability of the power tool. Accordingly, one or more embodiments of the present invention provide a single-hand operable switch with an enhanced operability, which allows the operator to switch on and off a plurality of control circuits by one hand.

In view of the foregoing, a switch according to one or more embodiments of the invention comprises:

a printed circuit board;

a first wiring pattern and a second wiring pattern provided on one surface of the printed circuit board;

a first crank member and a second crank member, each of the first and second crank members being supported for rotation above the printed circuit board;

a first switching slider configured to rotate with the first crank member as the first switching slider slides on the first wiring pattern; and a second switching slider configured to rotate with the first crank member as the second switching slider slides on the second wiring pattern;

the first and second crank members being positioned at respective positions where they are driven by one hand of an operator.

According to one or more embodiments of the invention, the first and the second crank member pushed by one hand provides an easy-handling switch translating a plurality of control circuit individually.

In one or more other embodiments of the invention of the switch, may further comprise a rotatably supported actuating lever through which the first crank member is rotated.

According to one or more embodiments of the invention, using the lever enables the first crank member to rotate with a small power by leveraging, which improves an operability.

In one or more embodiments of the invention of the switch may comprise:

a trigger;

a plunger having a longitudinal one and connected to the trigger so that the plunger is moved in a longitudinal direction thereof by a movement of the plunger; and an on/off slider mounted on the plunger so as to slider on the other surface of the printed circuit board.

According to this aspect of the invention, it is applied to a trigger switch, and a widely used switch is provided.

In one or more embodiments of the invention of the switch may comprise:

a first switching member having a first central axis, the first switching member being supported to move reciprocatingly along the first central axis and thereby to reciprocatingly rotate the first crank member; and a second switching member having a second central axis, the second switching member being supported to move reciprocatingly along the second longitudinal axis and thereby to reciprocatingly rotate the second crank member;

the first switching member and the second switching member being provided at respective positions where they are driven by one hand of the operator.

According to this aspect of the invention, the first and the second crank member pushed by one hand provides an easy-handling switch translating a plurality of control circuit individually.

In view of the foregoing, a power tool according to one or more embodiments of the present invention may comprise: the first switching member and the second switching member described-above, the first switching member and the second switching member being positioned at respective positions of the body housing where they are driven by one band of the operator.

Especially, the power tool of one or more embodiments of the present invention is not limited to a switch having the inner construction described above and it may comprise: a first switching member and a second switching member, the first switching member and the second switching member being positioned at respective positions of the body housing where they are driven by one hand of an operator.

According to one or more embodiments of the invention, the first and second crank member pushed by one hand provides an easy-handling electric tool translating a plurality of control circuit individually.

In one or more embodiments of the invention, the power tool may comprise:

a motor; and wherein the first switching member is configured to change a rotational direction of a motor.

According to one or more embodiments of the invention, a useful electric tool is provided due to switch the rotating direction of the motor in any direction by one hand.

In one or more embodiments of the invention, the power tool may comprise:

a motor; and wherein the second switching member is configured to change a rotational power of a motor.

According to one or more embodiments of the invention, a useful electric tool is provided due to switch the rotating power of the motor in any direction by one hand.

DETAILED DESCRIPTION

With reference to the accompanying drawings, FIGS. 1-22, a switch according to one or more embodiments of the invention will be described below. As shown in FIGS. 1-17, a switch of one or more embodiments is embodied in a trigger switch 20 which is incorporated in a body housing 11 of a power driver 10. It should be noted that although directional terminologies such as "upper", "lower", "left", "right", and other terms including any one of them are used in the following description, they are only used for the better understanding of the invention by way of the accompanying drawings. Therefore, the terminologies do not necessarily indicate the actual orientations of the product and then should not be construed so as to limit the technical scope of the invention.

Figure 1:
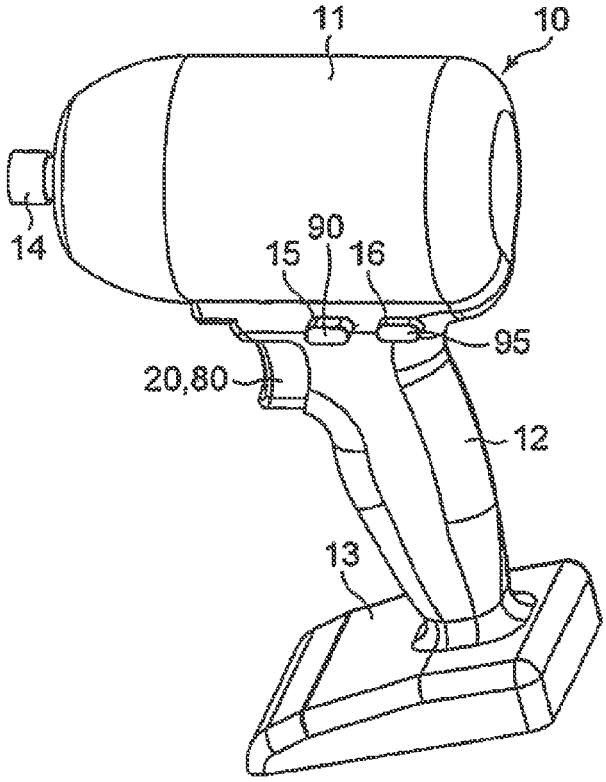
FIG. 1 is a perspective view showing a power driver incorporating a switch according to one or more embodiments of the invention.
Figure 2:
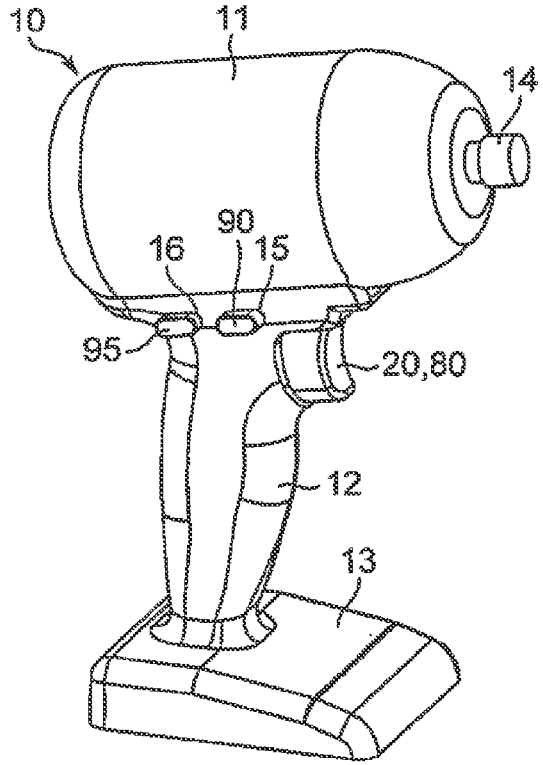
FIG. 2 is a perspective view of the power driver in FIG. 1 which is seen from a different direction in accordance with one or more embodiments.

As shown in FIGS. 1 and 2, the power driver 10 has a trigger switch 20 which is incorporated at a proximal portion of the grip 12 of the body housing 11. The grip 12 of the power driver 10 has a connector 13 provided at the bottom portion thereof for detachably receiving a battery pack not shown, so that the trigger switch 20 outputs signals for driving control circuits (not shown) including field-effect transistors (FETs) to supply electric power from the battery pack to a motor (not shown) through the control circuits for rotating the chuck 14 in a desired direction with a desired torque.

Figure 3:
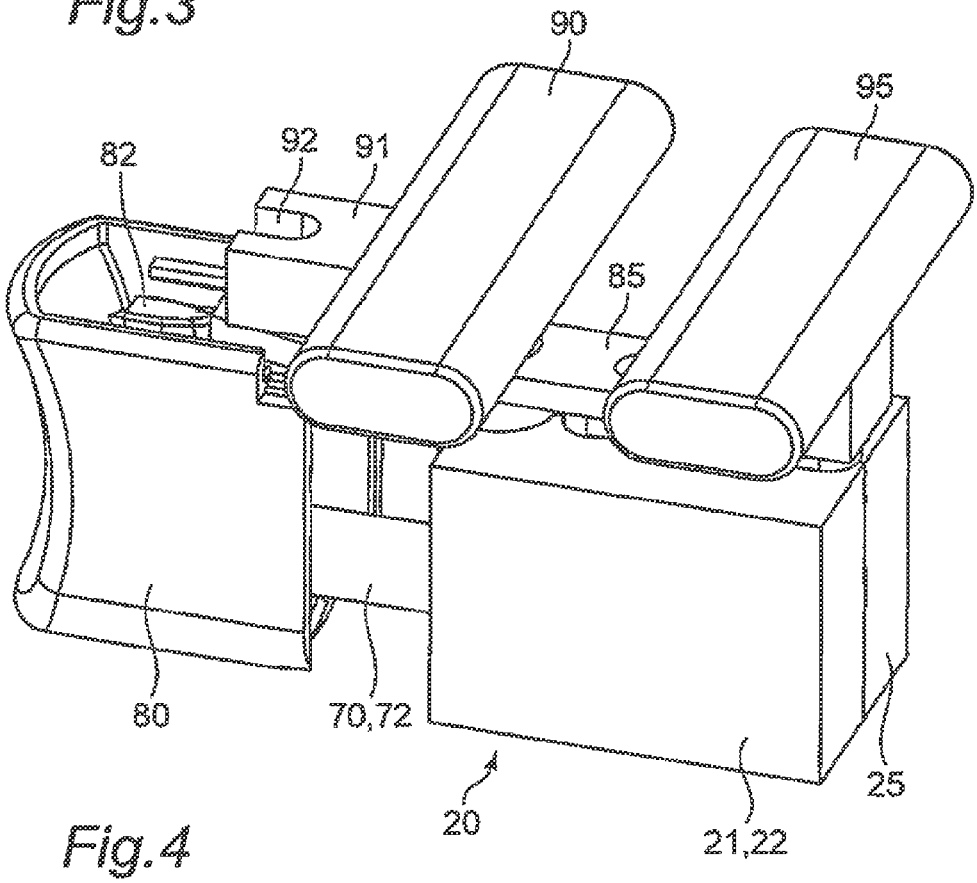
FIG. 3 is a perspective view of the switch in FIG. 1 in accordance with one or more embodiments.
Figure 4:
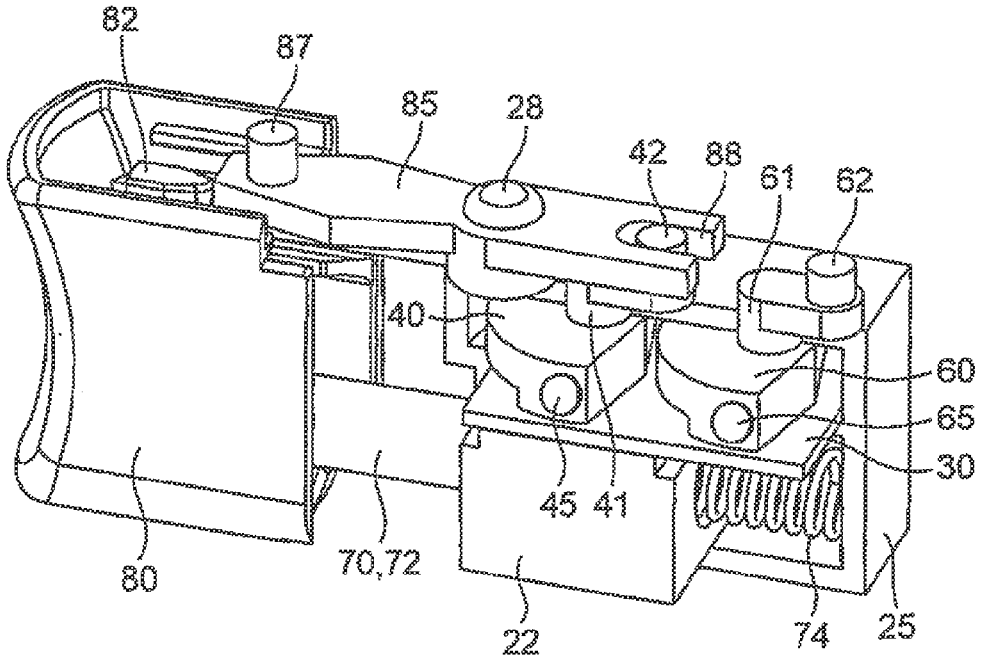
FIG. 4 is a perspective view showing a switch in FIG. 3, in which a first container half and first and second switching member are removed in accordance with one or more embodiments.

As shown in FIG. 3, the trigger switch 20 has a switching unit 21, a first switching member 90, and a second switching member 95.

Figure 5:
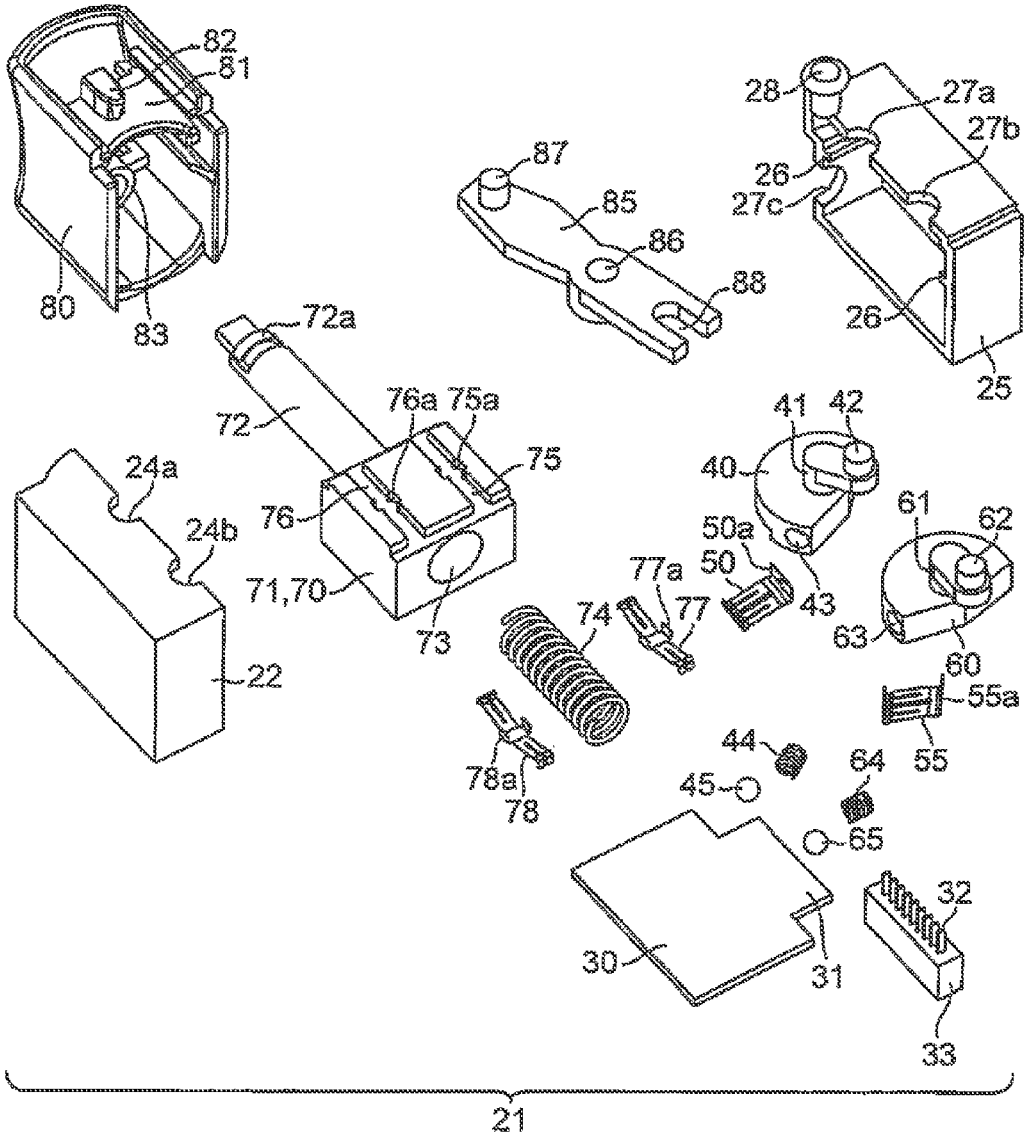
FIG. 5 is an exploded perspective view of the switch in FIG. 3 in accordance with one or more embodiments.
Figure 6:
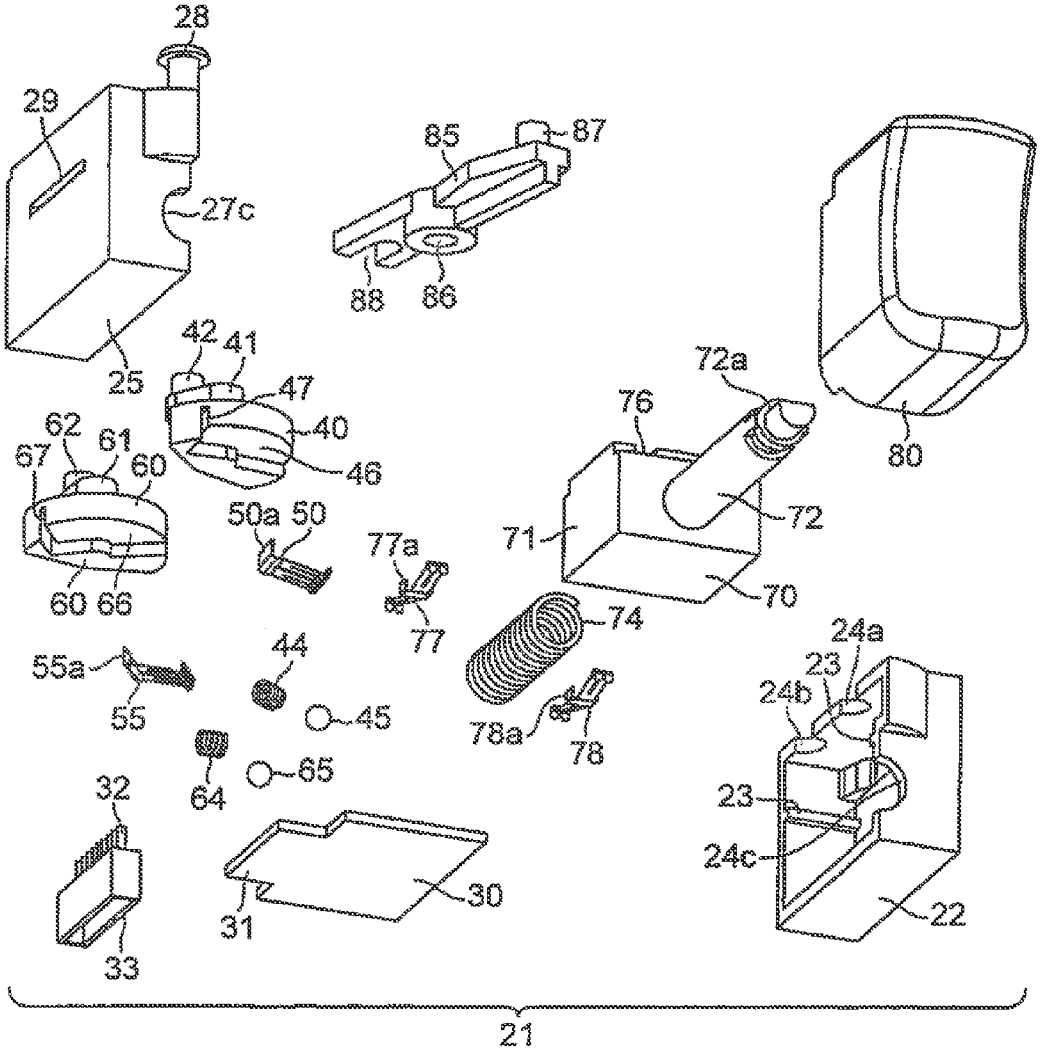
FIG. 6 is an exploded perspective view of the switch which is seen from a different direction in accordance with one or more embodiments.

As shown in FIGS. 5 and 6, the switching unit 21 has first and second container halves, or first and second container halves 22 and 25, designed to be assembled with each other for forming a container which receives various components such as a printed circuit board 30, first and second crank members 40 and 60, a plunger 70, etc. The switching unit 21 further includes a trigger 80 and an actuating lever 85.

Figure 15:
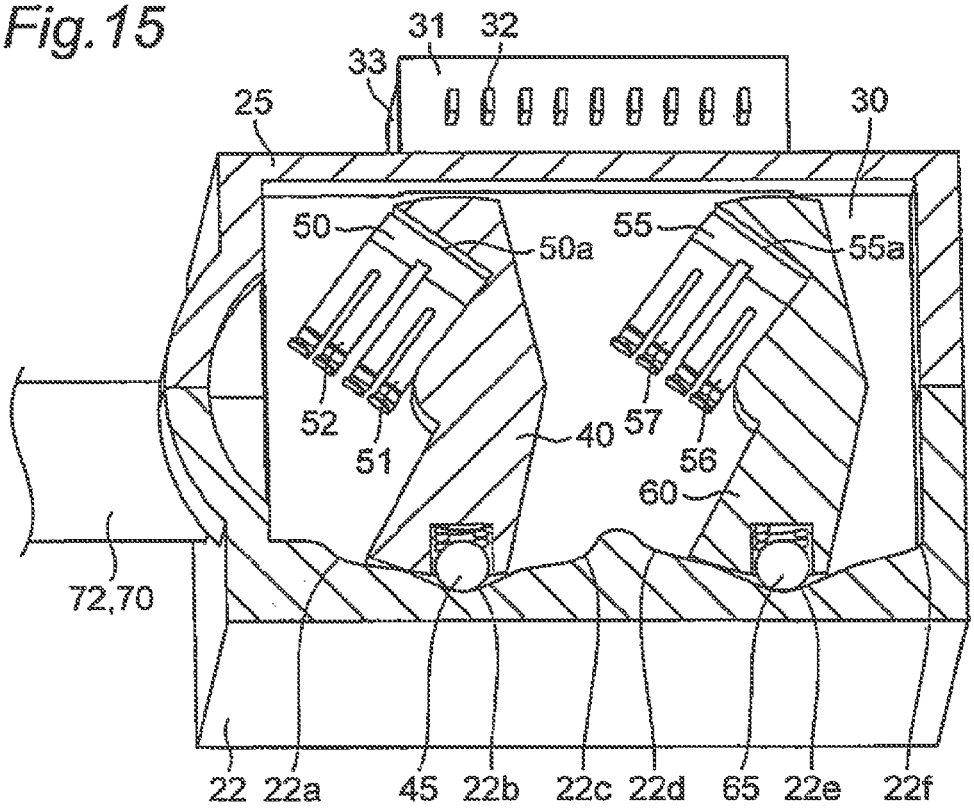
FIG. 15 is a horizontal cross sectional view showing the switch in FIG. 3 in accordance with one or more embodiments.
Figure 16:
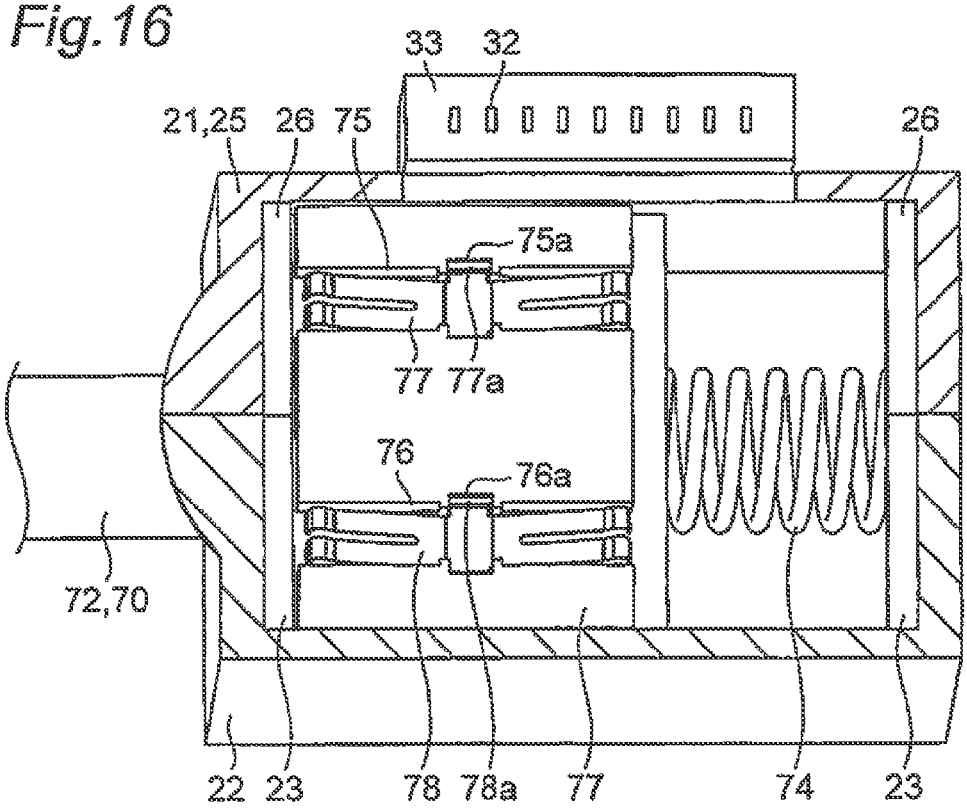
FIG. 16 is a horizontal cross sectional view taken along a plane at certain level that is different from that of FIG. 15 in accordance with one or more embodiments.
Figure 17:
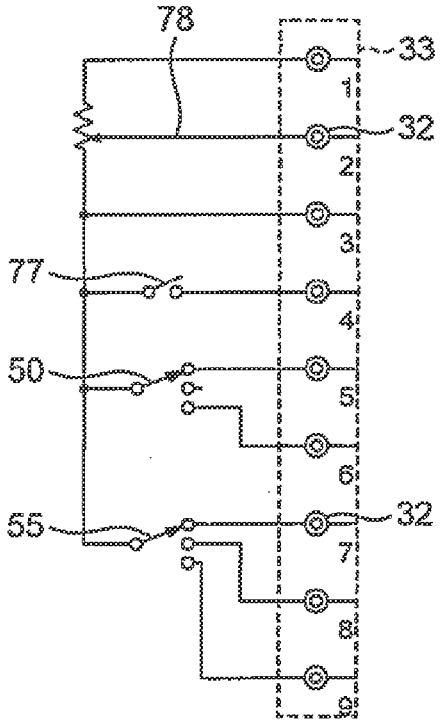
FIG. 17 is an electric circuit diagram of the switch in FIG. 1 in accordance with one or more embodiments.

As shown in FIGS. 5 and 6, the first container half 22, which is a box-like resin molding member, has a pair of opposed projecting ribs 23 integrally mounted on the opposing inner side surfaces thereof for receiving and positioning a printed circuit board 30 which will be described below. The first container half 22 also has a pair of semi-circular cutout 24*a* and 24*b* formed at an upper wall edge thereof and a semicircular cutout 24*c* formed at one side wall edge thereof for receiving an operating shaft 72 of a plunger 70 which will be described below. As shown in FIG. 15, the first container half 22 has a plurality of positioning dents 22*a*, 22*b*, 22*c*, 22*d*, 22*e*, and 22*f* integrally formed on an inner side surface which opposes the second container half 22 (described below) when the first and second container halves 22 and 25 are assembled with each other. The positioning dents 22*a*-22*f* are designed to provide click feeling to an operator of the power tool at the driving of the first or second crank member 40, 60.

As shown in FIG. 5, the second container half 25, which is a box-like resin molding member and defines an opening having an area which is substantially the same as that of the first container half 22, has a pair of opposed projecting ribs 26 integrally mounted on the opposing inner side surfaces thereof for receiving and positioning the printed circuit board 30 which will be described below. The second container half 25 also has a pair of semi-circular cutouts 27*a* and 27*b* and a shaft 28, both formed in an upper wall edge thereof. The second container half 25 has a semi-circular cutout 27*c* formed at one side wall edge thereof for receiving the operating shaft 72 of the plunger 70 which will be described below. Further, the second container half 25 has a slot 29 formed in a side wall opposing the first container half 26 when the first and second container halves 22 and 25 are assembled with each other. For convenience of description, the shaft 28 is illustrated in the drawings in such a manner that a top portion thereof is thermally deformed.

Figure 7:
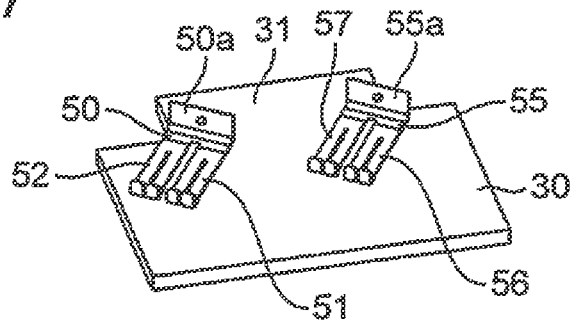
FIG. 7 is a perspective view showing a contact condition between a printed circuit board and first and second sliders in accordance with one or more embodiments.

As shown in FIG. 7, the printed circuit board 30 has a projected portion 31 which is projected sideway from a peripheral edge portion thereof. The printed circuit board 30 supports two, arch-like wiring patterns which extend around respective centers on the board. One wiring patterns, which are provided to change a rotational direction of the chuck 14, are designed so that two contacts 51 and 52 of a first slider 50 slidingly more on and along the patterns. The wiring patterns have a common wiring pattern 34 and a pair of driving force reciprocally switching wiring patterns 35*a* and 35*b* positioned in a coaxial fashion with the common wiring pattern 34 for switching a rotational direction of the motor. As shown, the driving force reciprocally switching wiring patterns 35*a* and 35*b* are separated and positioned symmetrically with respect to neutral positions provided therebetween.

The other wiring patterns, which are provided to change a rotational force or torque of the chuck 14, are designed so that two contacts 56 and 57 of a second slider 55 slidingly move on and along the patterns. The wiring patterns have a common wiring pattern 36 and a driving force stepwisely switching wiring patterns 37*b*, 37*a*, and 37*c* positioned in a coaxial fashion with the common wiring pattern 36 for changing the rotational force in three levels, i.e., high, intermediate, and low levels. The driving force stepwisely switching wiring patterns 37*b*, 37*a*, and 37*c* for the high, intermediate, and low rotational force are positioned on a circle (not shown) at regular intervals The printed circuit board 30 supports an on/off wiring pattern and a resistance wiring pattern provided in parallel on a bottom surface thereof. The on/off wiring pattern is made of a pair of conducting materials printed and aligned spacedly on a line not shown. Likewise, the resistance wiring pattern has a conducting material and a sliding resistance material printed and aligned spacedly on a line not shown. The sliding resistance of the resistance wiring pattern has conducting portions provided at opposite ends thereof. The projected portion 31 of the printed circuit board 30 supports a connector 33 having a number of terminals 32 aligned at regular intervals on the board for an electric connection with an external circuit not shown.

As shown in FIGS. 5 and 6, the first crank member 40, which is provided to change the rotational direction of the chuck 14, has a first rotating shaft 41 projected from the upper surface thereof and a first actuator 42 extending sideway from the top portion of the first rotating shaft 41. Also, the first crank member 40 has an outer peripheral surface including a first hole 43 defined therein. The first hole 43 receives a first helical spring 44 and a first ball 45 in this order so that the first ball 45 moves in and out of the hole 43. The first ball 45 acts to provide click feeling to the operator. As shown in FIG. 6, the first crank member 40 has a first step 46 formed in a bottom surface thereof for holding a first slider 50. The first step 46 has a first fit-in groove 47 formed at a corner thereof for holding a fit-in portion 50*a* of the first slider 50 (described below) fitted therein.

The first slider 50 also has two contacts 51 and 52 extending in parallel to each other from the one-end raised fit-in portion 50*a*. The contacts 51 and 52 form a twin contact structure in order to obtain an increased contact reliability of the slider. Likewise, the second slider 55 has two contacts 56 and 57 extending in parallel to each other from the one-end bent fit-in portion 55*a*. The contacts 56 and 57 form a twin contact structure in order to obtain an increased contact reliablity of the slider.

As shown in FIG. 5, the second crank 60, which is provided to change the rotational force of the chuck 14 in three levels, i.e., high, intermediate, and low levels, has a second shaft 61 projected from the upper surface thereof and a second actuator 62 extending sideway from the top portion of the second shaft 61. Also, the second crank member 60 has an outer peripheral surface including a second hole 63 defined therein. The second hole 63 receives a second helical spring 64 and a second ball 65 in this order so that the second ball 65 moves in and out of the hole 63 to provide click feeling to the operator. As shown in FIG. 6, the second crank member 60 has a second step 66 formed in a bottom surface thereof for holding the second slider 55. The second step 66 has a second fit-in groove 67 formed at a corner thereof for holding a fit-in portion 55*a* of the second slider 55 (described below) fitted therein.

As shown in FIG. 5, the plunger 70 has a base 71. The base 71 has a pair of opposed side surfaces, one supporting the operating shaft 72 projecting therefrom and the other having a fit-in hole 73 defined therein and aligned in the same direction with the operating shaft 72. The operating shaft 72 has an engagement rib 72*a* formed at one end thereof. The fit-in hole 73 receives a helical spring 74. The base 71 also has a pair of fit-in grooves 75 and 76 formed on a top surface thereof. The fit-in grooves 75 and 76 are formed in parallel to the operating shaft 72. The grooves 73 and 76 are designed to receive an on/off slider 77 and a resistance slider 78 which will be described below. The fit-in grooves 75 and 76 each has opposed fit-in recesses 75*a* and 76*a* formed at the respective centers of opposing inner side surfaces thereof.

As shown in FIG. 5, either end of the on/off slider 77 has a twin contact structure formed with a pair of spaced prongs. Also, the on/off slider 77 has a pair of elastic nails 77*a* formed at and raised from respective centers of longitudinal edges of the slider. The on/off sliders 77 are securely fitted in the fit-in groove 75 of the plunger 70 with the elastic nails 77*a* engaged in the recesses 75*a*.

As shown in FIG. 5, either end of the resistance slider 78 has a twin contact structure formed with a pair of spaced prongs. Also, the resistance slider 78 has a pair of elastic nails 78*a* formed at and raised from respective centers of longitudinal edges of the slider. The resistance sliders 78 are securely fitted in the fit-in groove 76 of the plunger 70 with the elastic nails 78*a* engaged in the recesses 76*a*.

Figure 12:
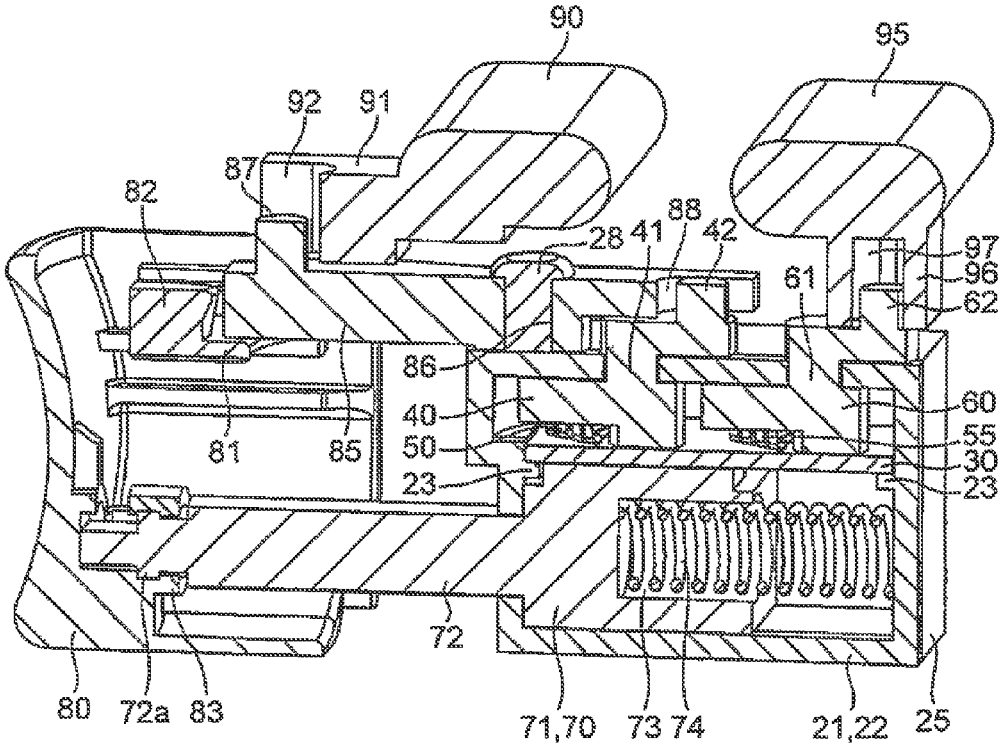
FIG. 12 is a central, longitudinal cross sectional view of the switch in FIG. 3 in accordance with one or more embodiments.
Figure 13:
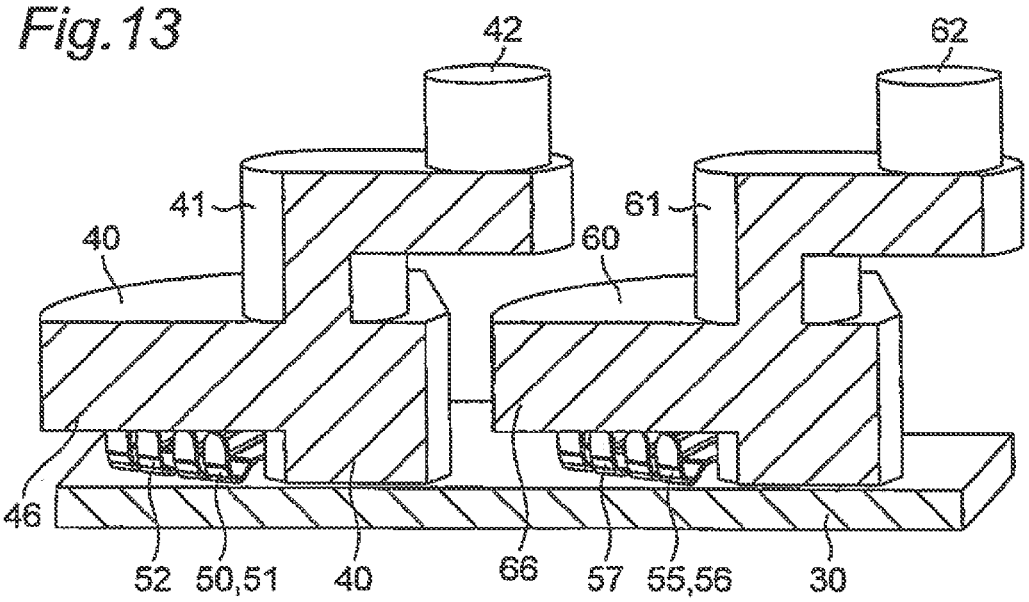
FIG. 13 is a partial enlarged cross sectional view showing details of the switch in FIG. 12 in accordance with one or more embodiments.
Figure 14:
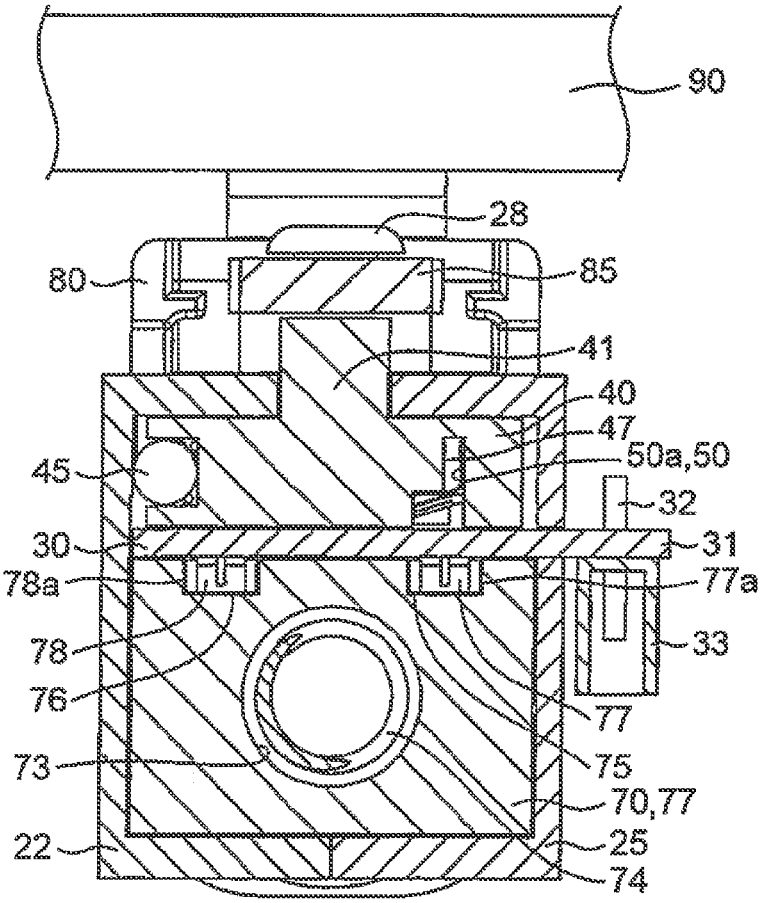
FIG. 14 is a vertical cross sectional view of the switch in FIG. 3 in accordance with one or more embodiments.

The trigger 80 is a mold member having a bracket-like cross section and has a reinforcement rib 81 extending between the opposed inner side surfaces. The rib 81 has a positioning boss 82 formed integrally at an upper central portion thereof. As shown in FIG. 12, the trigger 80 is assembled with the plunger 70 with the engagement rib 72*a* of the plunger 70 engaged in an associated portion 83 formed on an opposing inner sider surface of the trigger 80.

As shown in FIGS. 5 and 6, the actuating lever 85 has a shaft hole 86 formed at a central portion thereof, a projected portion 87 projected from one end thereof, and an engagement groove 88 formed at the other end thereof. The actuating lever 83 is supported for rotation with the shaft 28 of the second container half 25 inserted in the shaft hole 86.

Figure 10:
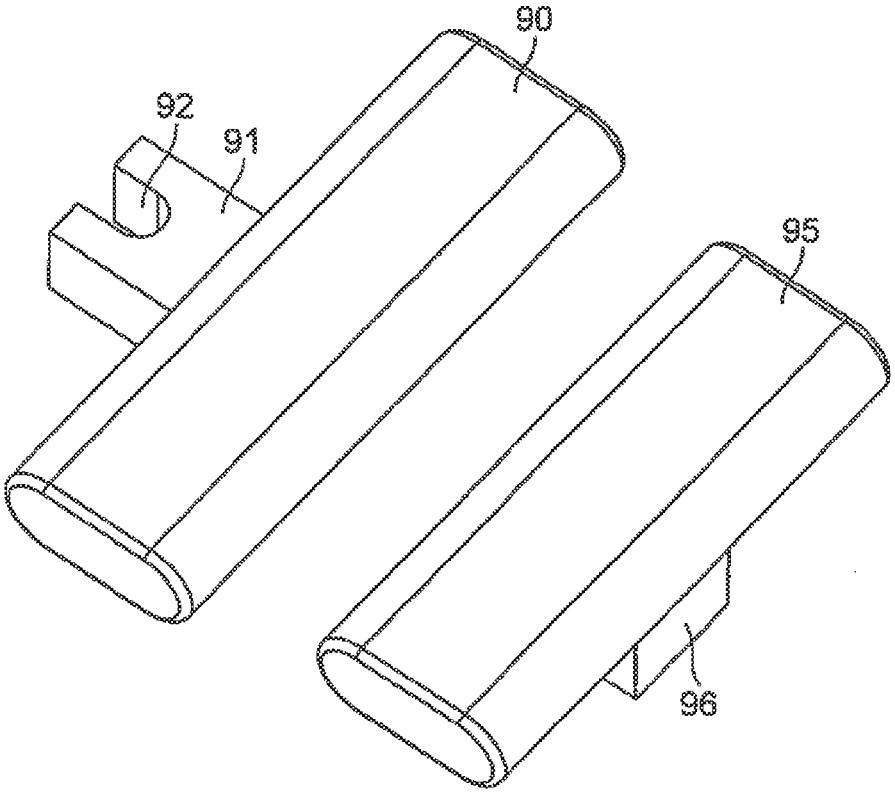
FIG. 10 is a perspective view of the first and second switching members of the switch in FIG. 3 in accordance with one or more embodiments.
Figure 11:
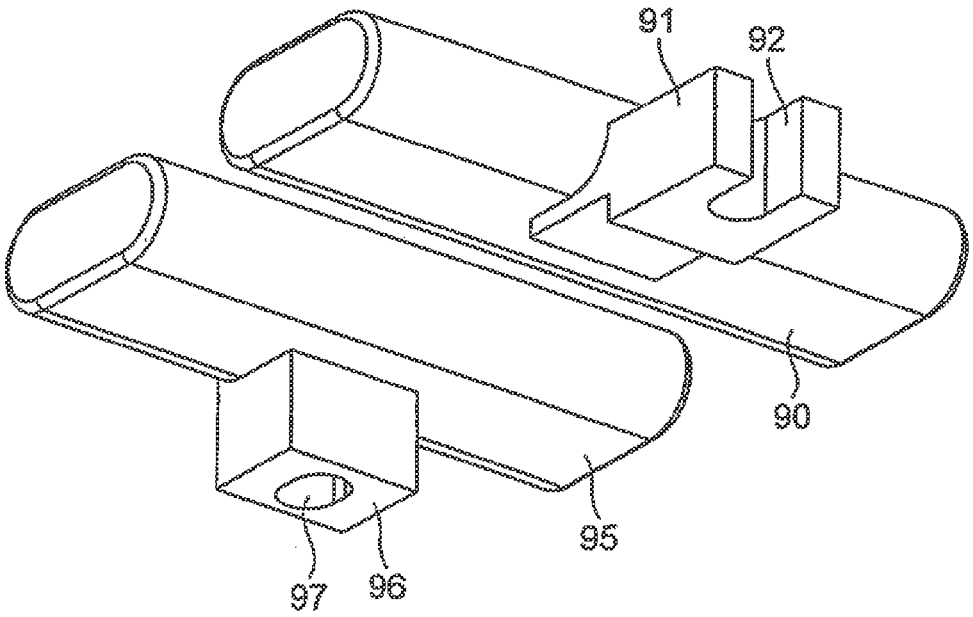
FIG. 11 is a perspective view showing the first and second switching members which are seen from a direction that is different from that of FIG. 10 in accordance with one or more embodiments.

As shown in FIGS. 10 and 11, the first switching member 90, which is made of a rod-like member having an ellipse cross section, is assembled for sliding movement in the corresponding hole 15 (see FIGS. 1 and 2) defined in the body housing 11. The first switching member 90 has a switching projection 91 projected from one side thereof. The switching portion 91 has an engagement recess 92 formed at a distal end thereof, in which the first actuator 87 of the actuating lever 85 engages.

As shown in FIGS. 10 and 11, the second switching member 95, which is made of a rod-like member having an ellipse cross section, is assembled for sliding movement in the corresponding hole 16 defined in the body housing 11. The second switching member 95 has a switching projection 96 projected from a bottom surface thereof. The switching portion 96 has an engagement hole 97 formed at a bottom surface thereof, in which the second actuator 62 of the second crank member 60 engages.

Discussions will be made to an assembling of the above-described components of the trigger switch 20. First, the elastic nails 77*a* of the on/off slider 77 are fitted in the recesses 75*a* of the fit-in grooves 75 of the plunger 70. Also, the elastic nails 78*a* of the resistance slider 78 are fitted in the recesses 76*a* of the fit-in groove 76 of the plunger 70. Further, the helical spring 74 is inserted in the engagement hole 73 of the plunger 70. Furthermore, the first helical spring 44 and then the first ball 45 are assembled in the first hole 43 of the first crank member 40. Likewise, the second helical spring 64 and then the second ball 65 are assembled in the second hole 63 of the second crank member 60. Then, the fit-in portion 50*a* of the first slider 50 is fitted in the first fit-in groove 47 of the first crank member 40. Also, the fit-in portion 55*a* of the second slider 55 is fitted in the second lit-in groove 67 of the second crank member 60.

Then, the printed circuit board 30 is positioned on the projecting ribs 26 of the second container half 25 with the projected portion 31 inserted through the slot 29. Subsequently, the first and second rotating shafts 41 and 61 of the first and second crank members 40 and 60 are fitted in the semi-circular cutouts 27*a* and 27*b* of the second container half 25, respectively. Also, the operating shaft 72 of the plunger 70 is fitted in the semi-circular cutout 27*c* of the second container half 25. Further, the first container half 22 is integrally assembled with the second container half 25. This results in an electric circuit shown in FIG. 17. Also, the first and second actuators 42 and 62 of the first and second crank members 40 and 60 are projected from the first and second container halves 22 and 25. Further, the connector 33 is mounted on the projected portion 31 of the printed circuit board 30. Furthermore, the first actuator 42 of the first crank member 40 is fitted in the engagement groove 88 of the actuating lever 85. The shaft 28 of the second container half 25 is inserted in shaft hole 86 of the actuating lever 85, and then the projected upper end of the shaft 28 is thermally deformed as shown in the drawings. Then, the trigger 80 is integrated with the plunger 70 with the engagement rib 72*a* of the plunger 70 engaged in an associated portion 83 of the trigger 80.

The first actuator 42 of the first crank member 40 is engaged with the first engagement recess 92 of the first switching member 90. Also, the second actuator 62 of the second crank member 60 is engaged with the second engagement hole 97 of the second switching member 95. Finally, the first and second switching members 90 and 95 are assembled in the corresponding holes 15, 16 of the power driver 10.

Figure 8:
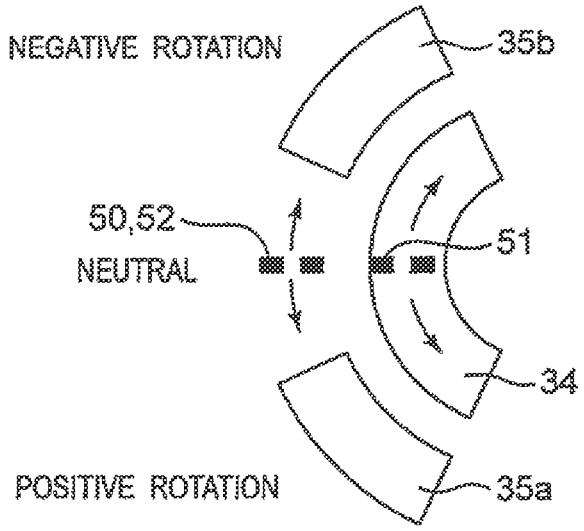
FIG. 8 is a plan view showing a driving force reciprocally switching wiring pattern provided on the printed circuit board in FIG. 7 in accordance with one or more embodiments.
Figure 9:
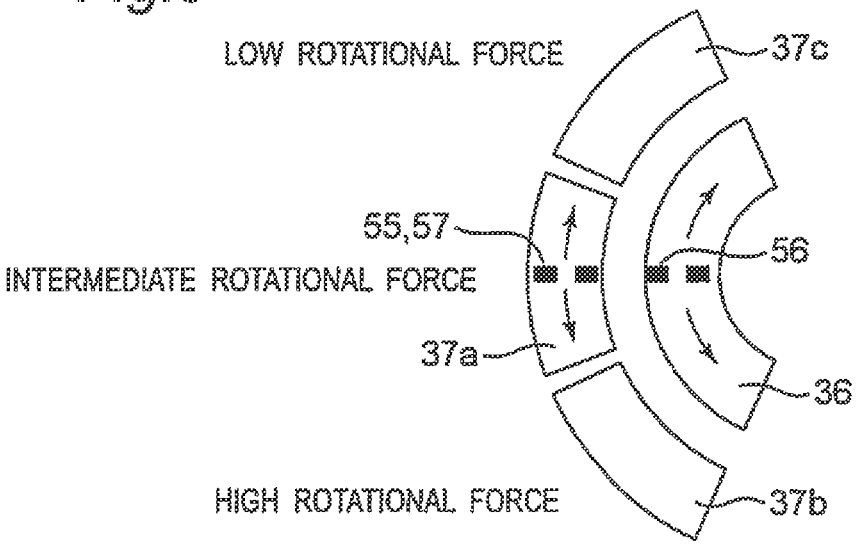
FIG. 9 is a plan view of a driving force stepwisely switching wiring pattern in three steps, i.e., high, intermediate, and low levels, which is provided on the printed circuit board in FIG. 7 in accordance with one or more embodiments.

Next, discussions will be made to an operation of the trigger switch 20. When the first switching member 90 takes its neutral position shown in FIG. 12, the actuating lever 85 takes its neutral position with its projected portion 87 engaged in the engagement recess 92 of the first switching member 90. In this condition, the positioning boss 82 of the trigger 80 positions on a central axis of the actuating lever 85, and the first slider 50 on the first crank member 40 takes its neutral position. As shown in FIG. 8, the contact 51 of the first slider 50 is in contact with the common wiring pattern 34 and the contact 52 is out of contact with any wiring pattern. Also, the trigger 80 is unable to be pulled in its longitudinal direction by the contact of the positioning boss 82 of the trigger 80 with the distal end portion of the actuating lever 85. This in turn prevents the plunger 70 from being moved in its longitudinal direction so that the on/off slider 77 and the resistance slider 78 on the base 71 are retained, without moving, on the lower surface of the printed circuit board 30.

Then, when the first switching member 90 is pressed in one direction from the rear surface to the front surface of the drawing shown in FIG. 12, the projected portion 87 of the actuating lever 85 engaging the engagement recess 92 of the first switching member 90 is forced in the same direction. This causes the actuating lever 85 to rotate in the counterclockwise direction about the shaft 28 on the second container half 25, which deflects the longitudinal axis of the actuating lever 85 from the positioning boss 82 of the actuating lever 85. This allows the first crank member 40 to rotate in the counterclockwise direction about the first rotating shaft 41 by the engagement of the first actuator 42 with the engagement groove 88 of the actuating lever 85. Also, the first slider 50 of the first crank member 40 moves in contact with the upper surface of the printed circuit board 30. As a result, as shown in FIG. 8, the contact 51 moves in contact with the common wiring pattern 34 and the contact 52 moves in contact with the driving force reciprocally switching wiring pattern 35*a* for rotations in the positive direction. In this movement, the first ball 45 of the first crank member 40 moves out of the positioning dent 22*b* of the first container half 22 and then into the neighborhood positioning dent 22*c* (see FIG. 15), which provides click feeling to the operator.

When the second switching member 95 takes the intermediate position for the intermediate rotational force (see FIG. 9), the second crank member 60 takes its neutral position with the second actuator 62 engaged in the engagement hole 97 of the second switching member 95. The contact 56 of the second slider 55 mounted in the second crank member 60 is in contact with the common wiring pattern 36, and the contact 57 is in contact with the driving force stepwisely switching wiring portion 37*a* for the intermediate rotational force. This causes that the second slider 55 is electrically connected to a circuit for generating the intermediate rotational force.

When the trigger 80 is pulled, the plunger 70 is slidingly forced inward along the central axis thereof against the force from the helical spring 74. This causes the on/off slider 77 and the resistance slider 78 on the base 71 of the plunger 70 to move in contact with the bottom surface of the printed circuit board 30. In this movement, the opposite ends of the resistant slider 78 are brought into contact with the associated resistant wiring pattern to make an electric connection therebetween. At this moment, neither end of the on/off slider 77 is out of contact with the associated on/off wiring pattern. This results in that no control signal is transmitted to the motor control circuit, so that the motor is in inoperative condition.

Further inward movement of the trigger 80 causes the on/off slider 77 to be brought into contact with the associated on/off wiring pattern, supplying electric current to the control circuit. Also, the resistance slider 78 moves with the inward movement of the trigger 80 to change the electric resistance. This in turn changes an electric signal to the control circuit depending upon the change of the electric resistance. The control circuit activates its FET transistor according to the electric signal to output an electric power to the motor. This causes the chuck 14 to rotate in the positive direction in a state capable of exerting the intermediate rotational force. The electric resistance increases with the inward movement of the trigger 80, which changes the control signal to increase and maximize the rotation number of the motor.

Once the trigger 80 is released, the plunger 70 is forced back by the biasing force from the helical spring 74. This causes the on/off slider 77 and the resistance slider 78 to move backward, decreasing the electric resistance and, as a result, the rotation number of the motor. When the rotation of the motor is halted, the trigger 80 returns its original position.

When the first switching member 90 is pressed in the opposite direction through the neutral position, from the front surface to the rear surface of the drawing shown in FIG. 12, the actuating lever 85 rotates about the shaft 28 in the clockwise direction. This results in that the first crank member 40, of which the first actuator 42 is in engagement with the engagement groove 88 of the actuating lever 85, rotates in the clockwise direction about the first rotating shaft 41. This in turn causes the first slider 50 on the first crank member 40 to move in contact with the upper surface of the printed circuit board 30. Also, as shown in FIG. 8, the contact 51 is brought into contact with the common wiring pattern 34, and the contact 52 is brought into contact with the driving force reciprocally switching wiring pattern 35*b* for driving the motor in the negative direction. Also, the first ball 45 of the first crank member 40 moves out of the positioning dent 22*c* of the first container half 22 through the positioning dent 22*b* (see FIG. 15) finally into the positioning dent 22*a*. In this movement of the ball, the operator experiences two click feelings.

When the second switching member 95 is pressed in a direction from the front surface to the rear surface of the drawing shown in FIG. 12, the second crank member 60 rotates about the second rotating shaft 61 in a counterclockwise direction. This causes that the second slider 55 of the second crank member 60 moves from the driving force stepwisely switching wiring portion 37*a* for the intermediate rotational force to the driving force stepwisely switching wiring portion 37*b* for the high rotational force where it is electrically connected to the control circuit for the high rotational force. In this movement, the second ball 65 of the second crank member 60 moves out of the positioning dent 22*e* of the first container half 22 then into the positioning dent 22*f*, which provides click feeling to the operator.

As described above, when the trigger 80 is pulled, the plunger 70 moves in the longitudinal direction thereof and the on/off slider 77 and the resistance slider 78 move in contact with the bottom surface of the printed circuit board to output associated control signals, which allows the chuck 14 to rotate in the opposite direction in a state capable of exerting the high rotational force.

Further movement of the second switching member 95 in the direction from the rear surface to the front surface of the drawing in FIG. 12 to the foremost end of its movable range, the chuck 14 can be rotated in a state capable of exerting the low rotational force.

Figure 18:
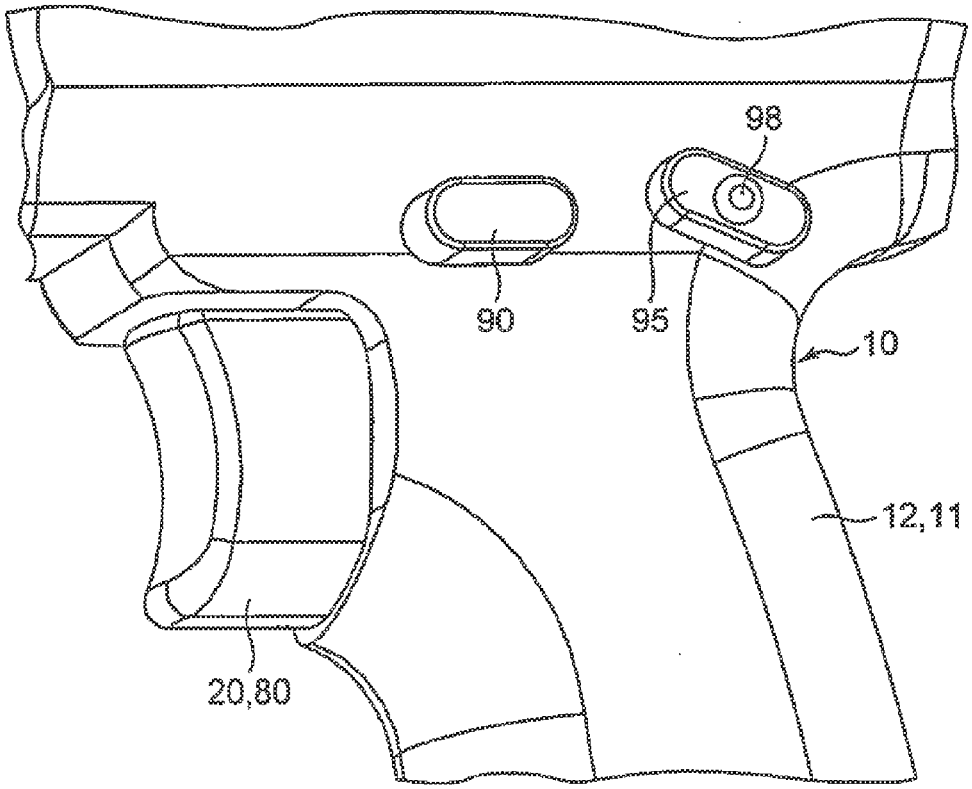
FIG. 18 is a partial enlarged perspective view of a power driver which incorporates a switch according to one or more embodiments of the invention.

FIG. 18 shows one or more embodiments which are substantially the same as one or more other embodiments except that the second switching member 95 is inclined to the body housing 11. Advantageously, one or more embodiments increase an operability and decreases likelihood of erroneous operation of the power driver. Another exception is that the second switching member 95 has a projection 98 formed on opposite end surfaces thereof. This arrangement further avoids the likelihood of erroneous operation of the power driver. Like parts are designated by like reference numerals and no further discussion is made to those parts because they are substantially the same as those of one or more other embodiments.

Figure 19:
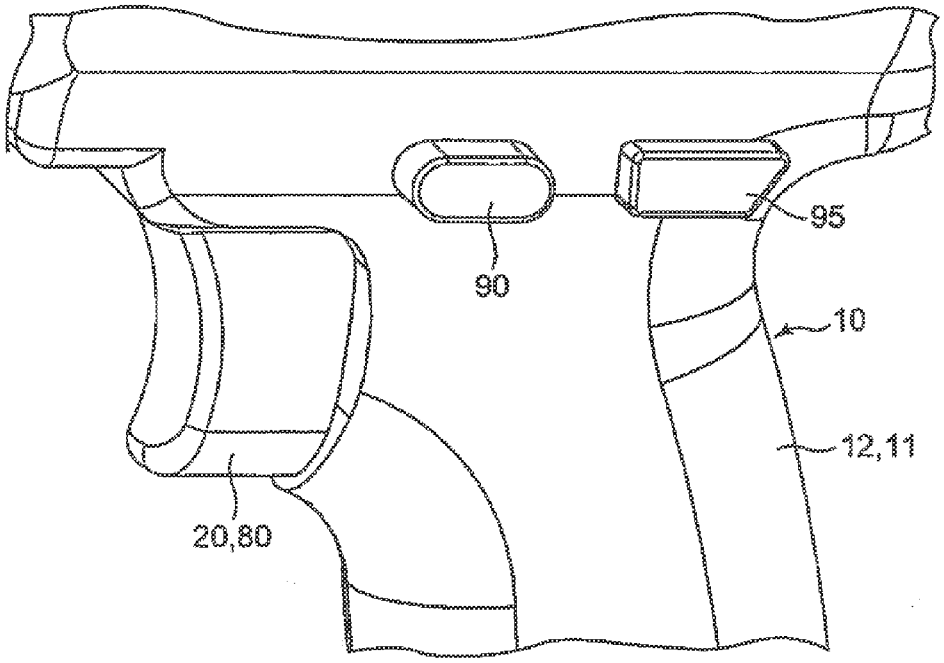
FIG. 19 is a partial enlarged perspective view of a power driver which incorporates a switch according to one or more embodiments of the invention.

FIG. 19 shows one or more embodiments which are substantially the same as other embodiments except that either end of the second switching member 95 has a trapezoidal cross section. This arrangement further avoids the likelihood of erroneous operation of the power driver. Like parts are designated by like reference numerals and no further discussion is made to those parts because they are substantially the same as those of one or more other embodiments.

Figure 20:
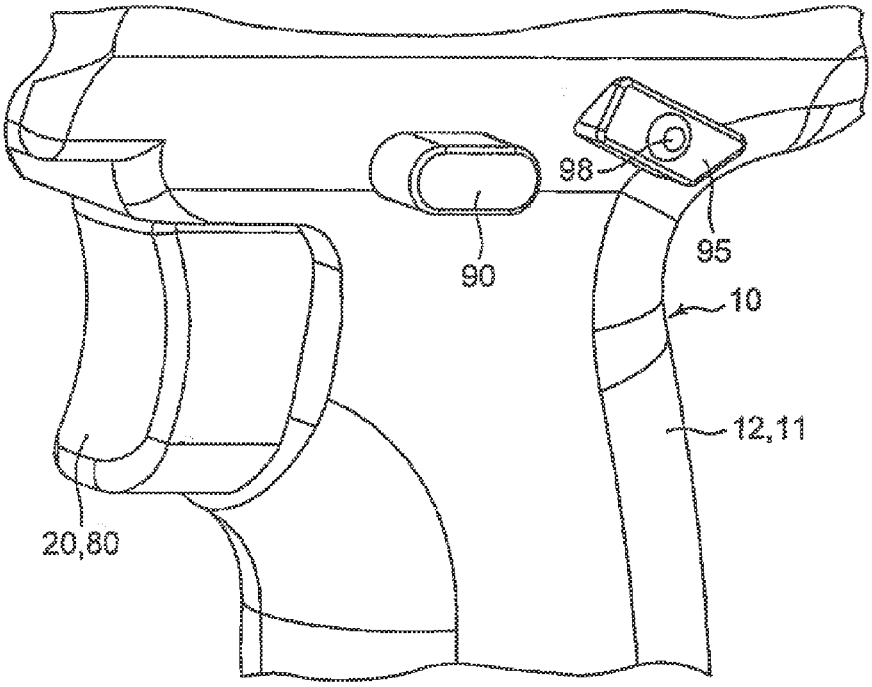
FIG. 20 is a partial enlarged perspective view of a power driver which incorporates a switch according to one or more embodiments of the invention.

FIG. 20 shows one or more embodiments which are substantially the same as one or more other embodiments except that the second switching member 95 is inclined to the body housing 11 and either end of the second switching member 95 has a trapezoidal cross section. Advantageously, one or more embodiments increase an operability and decreases likelihood of erroneous operation of the power driver. Another exception is that the second switching member 95 has a projection 98 formed on opposite end surfaces thereof. This arrangement further avoids the likelihood of erroneous operation of the power driver.

Figure 21:
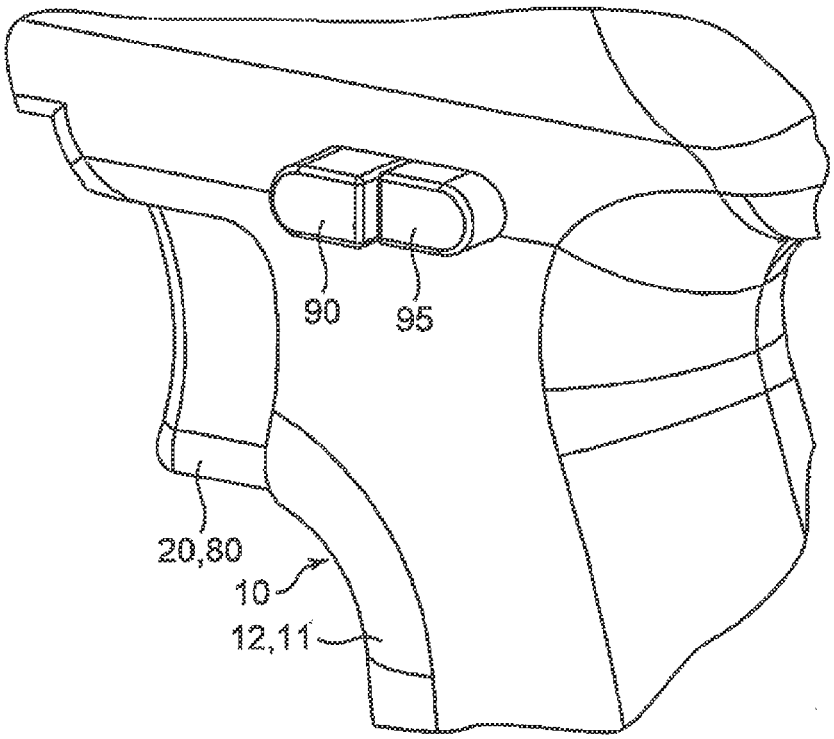
FIG. 21 is a partial enlarged perspective view of a power driver which incorporates a switch according to one or more embodiments of the invention.

FIG. 21 shows one or more embodiments which are substantially the same as one or more other embodiments except that the first and second switching members 90 and 95 are positioned side-by-side. According to this arrangement, the operator can operate the switch with minimum finger movements, which increases the operability of the power driver. Another exception is that the longitudinal ends of the first switching member 90 are shifted in that direction from those of the second switching member 95 to form height differences therebetween, which ensures to avoid the likelihood of erroneous operation of the power driver.

Figure 22:
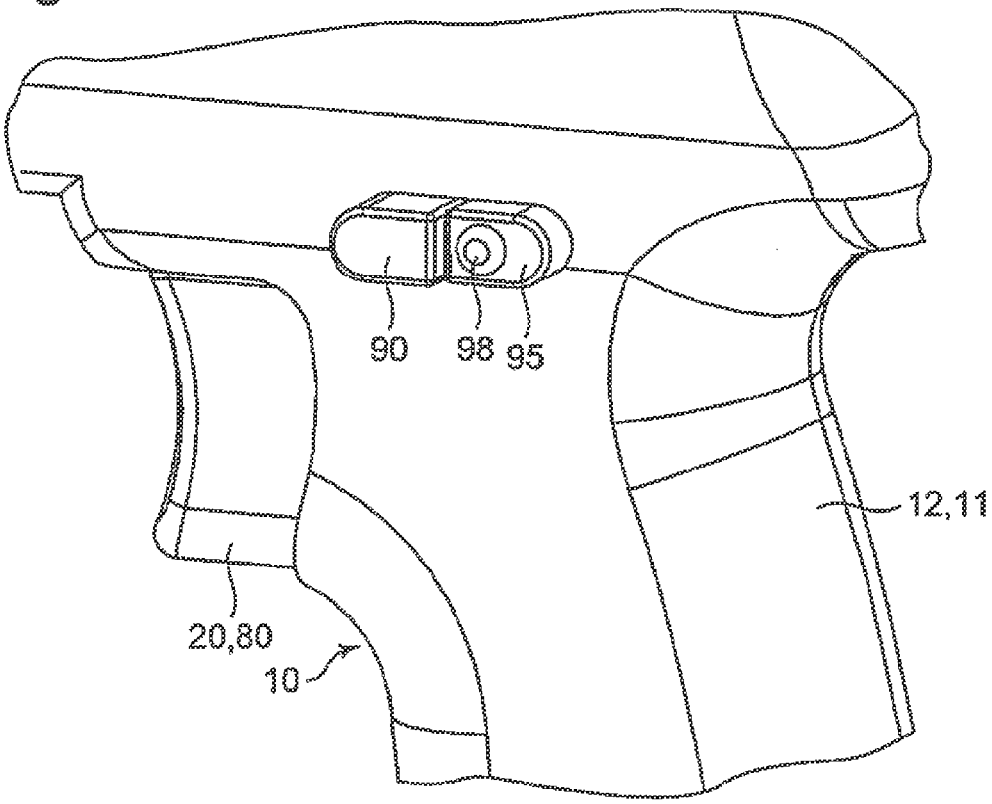
FIG. 22 is a partial enlarged perspective view of a power driver which incorporates a switch according to one or more embodiments of the invention.

FIG. 22 shows one or more embodiments which are substantially the same as one or more other embodiments except that the second switching member 95 has a projection 98 formed on opposite end surfaces thereof. This arrangement further avoids the likelihood of erroneous operation of the power driver.

Although the rotational force is changed in three levels in the one or more embodiments, it may be changed in two levels, i.e., high and low rotational forces, or in four or five levels. The switch according to one or more embodiments of the invention may be used for changing operational conditions thereof as well as changing rotational direction or force of the power tool.

INDUSTRIAL APPLICABILITY

Although discussions have been made to one or more of the embodiments in which the invention is applied to the trigger switch, the invention may be applied to various switches for changing other control circuits.

Although discussions have been made to one or more of the embodiments in which the invention is applied to the power driver, the invention may be applied to other power tools such as impact driver and power saw. Also, one or more of the invention are not limited to the power tool with the switch described above and can be applied to other power tools in which the first and second switching members are provided at respective positions where the operator can access with his or her fingers while holding the grip or handle of the body housing by one hand. Also one or more of embodiments of the invention may have three or more switching members.

Further, although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims

PARTS LIST

10: power driver
11: body housing
12: grip
14: chuck
15: corresponding hole
16: corresponding hole
20: trigger switch
21: switch unit
22: first container half
23: projecting rib
25: second container half
26: projecting rib
28: shaft
30: printed circuit board
31: projected portion
32: terminal
33: connector
40: first crank member
41: first rotating shaft
42: first actuator
44: first helical spring
45: first ball
50: first slider
51: contact
52: contact
55: second slider
56: contact
57: contact
60: second crank member
61: second rotating shaft
62: second actuator
64: second helical spring
65: second ball
70: plunger
71: base
72: operating shaft
73: fit-in hole
74: compressed helical spring
75: fit-in groove
76: fit-in groove
77: on/off slider
78: resistance slider
80: trigger
81: reinforcement rib
82: positioning boss
85: actuating lever
86: shaft hole
87: projected portion
88: engagement groove
90: first switching member
91: switching portion
92: engagement recess
95: second switching member
96: switching projection
97: engagement hole
98: projection

What is claimed is:

1. A switch mechanism, comprising:

a first switching member configured to reciprocally move straight in a direction;

a second switching member configured to reciprocally move straight in the direction, the first switching member and the second switching member being disposed close to each other so that an operator can operate the first switching member and the second switching member by his or her one hand;

a first crank member mounted for rotation about a first axis, the first crank member being engaged with the first switching member so that the first crank member reciprocally rotates about the first axis as the first switching member reciprocally moves straight;

a second crank member mounted for rotation about a second axis, the second crank member being engaged with the second switching member so that the second crank member reciprocally rotates about the second axis as the second switch member reciprocally moves straight;

a first slider mounted on the first crank member;

a second slider mounted on the second crank member;

a printed circuit board;

a first wiring pattern printed on the circuit board, the first wiring pattern being disposed so that the first slider makes contacts with the first wiring pattern during the rotation of the first crank member; and a second wiring pattern printed on the circuit board, the second wiring pattern being disposed so that the second slider makes contacts with the second wiring pattern during the rotation of the second crank member.

2. The switch mechanism of claim 1, wherein the first slider includes a first contact portion and a second contact portion; and wherein the first wiring pattern comprises:

a first wiring portion extending continuously in a first peripheral direction about the first axis so that the first contact portion is always in contact with the first wiring portion during the rotation of the first crank member; and a second wiring portion having a first segment and a second segment, the first segment and the second segment being spaced away from each other to define therebetween a zone in which the second contact portion is in contact with neither the first segment nor the second segment.

3. The switch mechanism of claim 2, wherein the second slider comprises a first contact portion and a second contact portion, wherein the second wiring pattern comprises:

a first wiring portion extending continuously in a second peripheral direction about the second axis so that the first contact portion of the second slider is always in contact with the first wiring portion of the second wiring pattern during the rotation of the second crank member, and a second wiring portion comprising a first segment, a second segment, and a third segment, the second segment and the third segment of the second wiring pattern being disposed on opposite sides of the first segment of the second wiring pattern and spaced away from the first segment of the second wiring pattern in the peripheral direction about the second axis.

4. A power tool, comprising the switch of claim 1.

5. A power tool, comprising the switch of claim 3.

* * * * *